United States Patent [19]

Warehime

[11] 4,335,881

[45] Jun. 22, 1982

[54] MULTI-SECTIONAL ASSEMBLED BASKET GOALS AND THEIR GAMES USAGE

[76] Inventor: Norwood R. Warehime, 704 W. 34th St., Baltimore, Md. 21211

[21] Appl. No.: 198,060

[22] Filed: Oct. 17, 1980

[51] Int. Cl.[3] ..... A63B 63/00

[52] U.S. Cl. ..... 273/348; 46/31; 150/48; 273/1.5 R; 273/411

[58] Field of Search ..... 273/411, 1.5 R, 348, 273/398, 342; 46/30, 31; 150/0.5, 48, 49, 50, 51

[56] References Cited

U.S. PATENT DOCUMENTS

| | | | |
|---|---|---|---|
| 2,861,277 | 11/1958 | Hermann | 150/0.5 X |
| 3,469,844 | 9/1969 | Sindelar | 273/1.5 R X |
| 3,951,294 | 4/1976 | Wilson | 46/30 X |

OTHER PUBLICATIONS

Laundry Basket Advertisements of Loma, Lancaster Co. of Ft. Worth, Tx. and Action Industries, Inc. of Chesnick, Pa.

*Primary Examiner*—William H. Grieb

[57] ABSTRACT

Three to six thin, pliable, plastic trapezoidal shaped sections can be used to assemble a practical, convenient, lightweight bottomless type basket which can be used as a goal in a variety of simple indoor/outdoor team action games. The plactic sections have male-female interlocking side edge slip jointing means on two side edges and stiffening rims on the other two side edges. All sections are identical and can be stacked in a compact manner for packaging, transport, and storage. Baskets assembled using the sections are safe, lightweight, pliable, inexpensive, adaptable to stacking, and are suitable for use as goals in game play. The sections can be colored for visual effects, and perforated to reduce material costs and to give sections and baskets added pliability. The multi-sectional assembled basket goals, together with appropriate game ball, playing area, and playing surface, can be used in game play by two teams of from three to eight players each. Four team action games are described: a mini-version of European team handball using a solitary basket goal placed in a limit circle; a mini-version of basketball using two basket goals, each placed in a limit circle on playing surface; a mini-version of football (soccer) using four basket goals in a square pattern, with diagonally opposite goals for the respective teams; and a new and unique game that can be played by three players per team on practically any type surface using four basket goals in a square pattern with 5 mts (5 yds) spacing and a small lively play ball which can only be tapped by flat of hand for passing and shooting. Ball can not touch playing surface or possession is lost. Assembled baskets can also be used for other games, as decorative and boundary indicating means, and as construction assembly items for children.

6 Claims, 8 Drawing Figures

FIG. 1
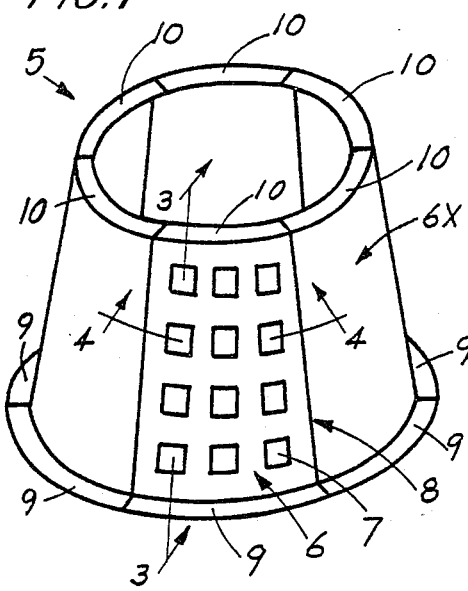
FIG. 2
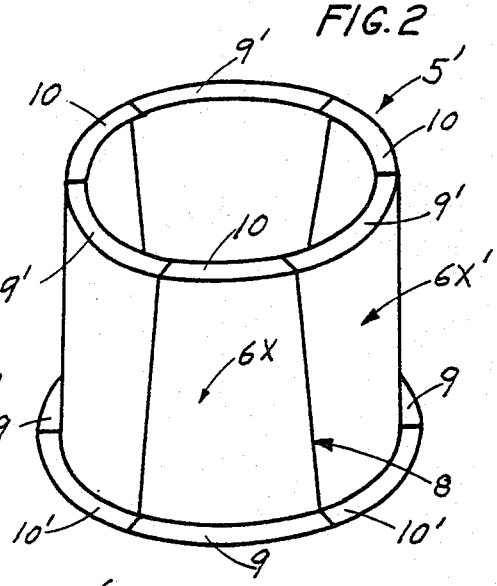
FIG. 3
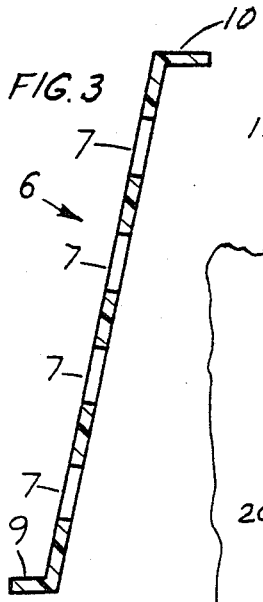
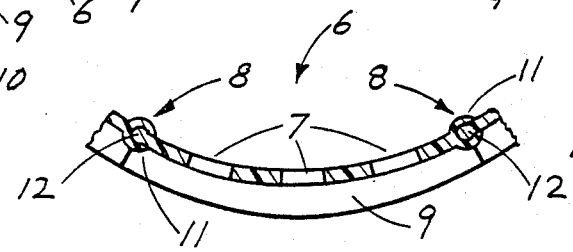
FIG. 4
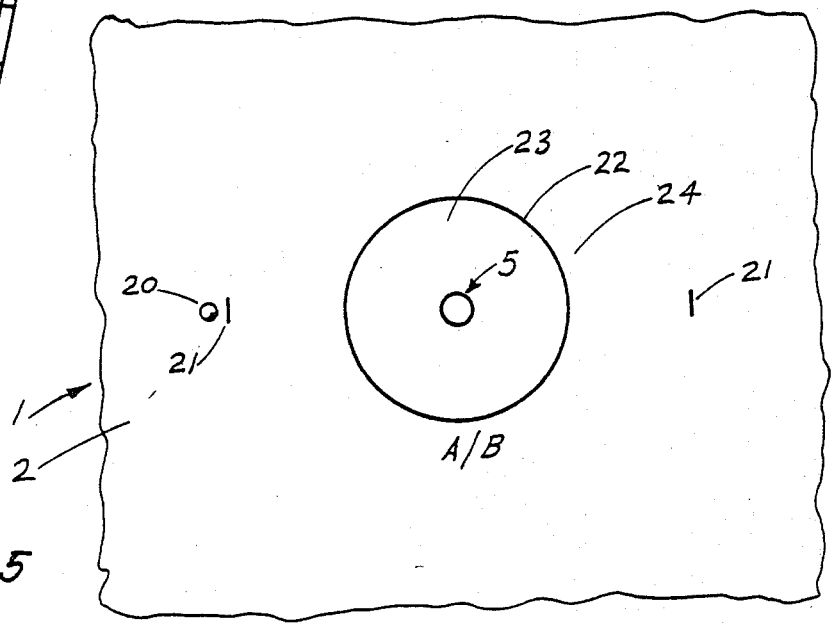
FIG. 5

MULTI-SECTIONAL ASSEMBLED BASKET GOALS AND THEIR GAMES USAGE

TECHNICAL FIELD

The invention relates to multi-sectional assembled basket goals and their games usage; a number of identical thin plate-like plastic molded sections can be assembled to form bottomless basket type goals which can be used together with appropriate type balls in a variety of simple indoor/outdoor team action games.

BACKGROUND ART

Competitive team action games use a variety of goal types. One simple form of goal used for several games is a basket having the shape of a conic section with a rigid rim in the horizontal plane, mesh sides, and end openings. Many other goals have the familiar rigid rectangular frame shape in the vertical plane with mesh sides and back, and with front opening. Most goals of the above types are permanently installed, expensive, bulky, and used for a single type of game. Also, many of the above goals are not suitable for use by children and adults with limited abilities because of height, size, and spacing between goals. Some available game areas for children and adults are just not suitable for expensive or permanent goal installations. Portable goals when used, in general, can be bulky, expensive, and limited in their use. Player safety, maintenance, and possible vandalism are other factors to be considered on the general subject of goals.

The team action games referred to in this invention have been played using standard plastic conic section shaped laundry baskets with their bottoms cut out. Use of such baskets in an inverted position provides practical, safe, inexpensive, colorful, and versatile type goals. However, these goals are quite bulky when considered as a packaged product for portable use, even though they can be stacked in a space saving manner. Baskets of the above type are typical of those made by the Lancaster Colony Company of Fort Worth, Tex., U.S.A. (Type No. 155), and by Action Industries, Inc. of Cheswick, Penn., U.S.A. (Type No. 2630, 2640, 2650, and 2700). Bottoms of the baskets are cut out with a knife, and the baskets are used in an inverted position to provide stability. There are no patents or other documents known by inventor that relate to baskets that can be assembled from molded plastic sections for use as goals in a variety of simple indoor/outdoor team action games.

DISCLOSURE OF INVENTION

The invention as claimed is intended to provide practical, multi-sectional assembled basket goals which can be used ideally in a variety of team action games. It solves the problem of how to design a sectional plastic shape that can be used in quantity to assemble practical, safe, inexpensive, colorful, and versatile basket goals. The sectional shape is lightweight, pliable, compact, adaptable to stacking, and can be made in a number of colors. Only one forming mold is needed for production of standard plastic section shape since all shapes are the same. Sections are readily fastened together in an assembly by use of male-female longitudinal interlocking side edges. Three to six sections can be used in an assembly to form a basket goal. One to four assembled basket goals are used in a variety of team action games.

The advantages offered by the invention are mainly that all sectional shapes are identical, require only one forming mold in production, are compact and adaptable to stacking for packaging or transporting, and are easy to assemble into basket goals. Baskets assembled from sectional shapes are safe, lightweight, pliable, adaptable to stacking, inexpensive, and are suitable for use as goals in a variety of simple indoor/outdoor team action games. Three of the four games described herein are miniversions of standard games, while the fourth game is new and unique.

BRIEF DESCRIPTION OF DRAWINGS

The invention is described in detail with reference to drawings which illustrate one specific embodiment of the sectional plastic shape and one optional shape, plus overall views and details of the assembled baskets and how they are used in four different games.

FIG. 1 is a perspective view of an assembled six section conic type basket in an inverted position, as it is normally used in game play. One of the six sections is shown in detail with molded or cut-out square holes. The other sections are similar in construction but are shown in blank form for simplicity and clarity reasons.

FIG. 2 is an optional type assembled basket in a substantially cylindrical shape with same basic main individual sectional body but with modified edges to accommodate assembly. All sections are shown in blank form.

FIG. 3 is a longitudinal sectional cut view of basket section of FIG. 1 showing upper and lower edges and square holes.

FIG. 4 is a transverse sectional cut view of basket section of FIG. 1 showing male-female longitudinal interlocking side edges and square holes.

FIG. 5 is a plan view of game area showing solitary basket goal, limit circle, game starting lines, and game ball for a mini-version of a one goal type European team handball game.

DESCRIPTION AND PREFERRED EMBODIMENT FOR CARRYING OUT INVENTION

Figure 6:
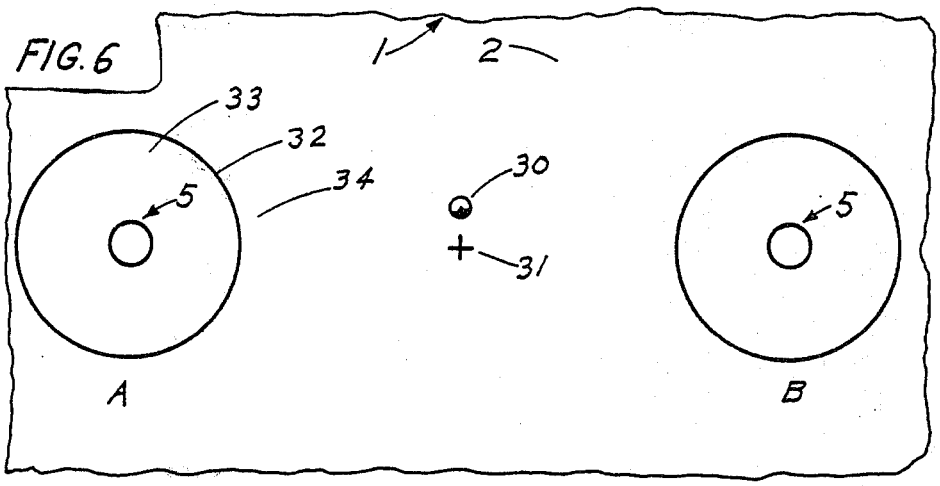
FIG. 6 is a plan view of game area showing two basket goals with limit circles, game starting spot, and game ball for a mini-version of basketball.

FIG. 1 is a perspective view of an assembled sectional basket in a conic type shape which is generally indicated by numeral 5. The basket is assembled using six identical plastic sections generally indicated by numeral 6. The one centrally positioned section in full view is shown in details with holes in it, and the five other sections are shown in blank form for simplicity and clarity reasons, and are generally indicated by designation 6X. In actuality, all sections would be identical and be perforated. Holes in sections are indicated by 7, section joints by 8, section bottom edge by 9, and section top edge by 10. Sectional cut views are indicated by cut lines 3 and 4, and are detailed in FIGS. 3 and 4 respectively. FIG. 2 is an optional type assembled sectional basket in a substantially cylindrical shape generally indicated by 5', using three of the same basic individual sections 6 (or 6X) as shown in FIG. 1 plus three sections with all edges modified and indicated by 6' (or 6X') to accommodate assembly. Modified top and bottom edges are indicated by 9' and 10' respectively. The interlocking male-female side edge joints 8 are same as in FIG. 1 and as detailed in FIG. 4. FIG. 3 shows a longitudinal sectional cut of basic section piece 6 detailing holes 7, bottom edge 9, and top edge 10. Holes are used to reduce material costs, to reduce weight, and to provide flexibility in sections and assembled baskets. FIG. 4 shows a transverse sectional cut of basic section piece 6 detailing edge joints 8 comprising male longitudinal cylindrical solid edges 12 inserted into female longitudinal cylindrical cavity edges 11. All six joints 8 of assembled basket 5 (or 5') are the same as shown in FIG. 4 detail. Joints 8 are formed by sliding male edges 12 lengthwise into female cavity edges 11. Plastic sections 6 (or 6X or 6X') are pliable and have sufficient slippage and tolerance in edge design to facilitate secure joint formation and basket assembly.

A preferred embodiment of a conic type basket goal would comprise six identical plastic sections assembled to form one basket with the following dimensions: top ring inside diameter of 30 cms (approx. 12 inches); top ring outside diameter of 34 cms (approx. 13 inches); bottom ring inside diameter of 46 cms (approx. 18 inches); bottom ring outside diameter of 50 cms (approx. 20 inches); and a vertical height of 34 cms (approx. 13 inches). Material thickness would be about 2.0 mm (approx. 1/16 inches) or slightly greater. Plastic sections could be in various colors for decorative and goal distinguishing effects. Each individual section should have about six square holes in the transverse direction, and about eight square holes in the longitudinal direction. Rib thickness could be varied for best design regarding material usage, strength, pliability, and cost. Plastic material should have sufficient pliability to facilitate readily forming of secure slip joints with longitudinal edges of sections. A stack of six sections could be reduced to an overall size of about $7.5\times22.8\times38.1$ cms (approx. $3\times9\times15$ inches), and a stack of twenty-four sections, sufficient to assemble a set of four basket goals, could be packaged in a box size of about $12.5\times22.8\times43.1$ cms (approx. $5\times9\times17$ inches). A basket could be assembled in several minutes. Once baskets are assembled, they can also be stacked for temporary transport or storage. Weight of one basket goal should be about 340 gms (approx. $\frac{3}{4}$ pounds), or a set of four baskets should be about 1.36 kgs (approx. 3.0 pounds).

FIG. 5 shows general layout for playing "Mini-Team Handball", in which playing area of at least 10 mts (10 yds) square is generally indicated by numeral 1, playing surface of smooth, hard, and level material, either indoors or outdoors, is indicated by 2, a solitary assembled basket goal in an inverted position on surface 2 is indicated by 5, a 4 mts (4 yds) diameter limit circle 22 surrounds goal 5, and two starting lines are indicated by 21. Letters A/B below circle 5 indicate that goal and circle are used by both teams in a similar manner. Area represented by 24 outside of circle 22 is the valid playing area where shot at goal is permitted, and area 23 inside circle 22 is a non-valid area for offensive and defensive game play. A loose ball in area 23 can be cleared by either team using hands or feet, but players normally can not remain in area 23 for more then three seconds without drawing a minor foul. "Mini-Team Handball" is a dynamic, informal, contact type game played by two teams of four to eight players each, and reasonable body contact is permitted. A ball indicated by 22 is a lively, lightweight plastic or rubber type about 12.5 cms (5 inches) in diameter, and it can be passed or bounced as in basketball or European team handball. Team that starts game, or resumes game play after score, starts from either starting line 21 which is 2 mts (2 yds) back from circle. Ball is advanced by bounding or passing, but ball possession is limited to 5 seconds per player and 10 seconds per team per possession. That means passes between players or shot at basket goal must be made within those time limits or ball possession is lost. Shot at goal must be from outside circle. Defenders can put one foot only in circle, or can grab ball, or arm or body of offensive player with ball to stop shot attempt. Such arm or body contact action is a minor four and results in a non-shooting penalty. Play is restarted by fouled player making a ball pass to one of his team-mates located in a position no closer to goal then point of foul as in European team handball or water polo. A valid shot into goal results in a one point score. Major or dangerous fouls result in a free foul shot at goal from a point 2 mts (2 yds) back from circle. In general, game rules can be adjusted to suit age of players and degree of formality of game play. Existing jump circles on basketball court layout can be used as limit circles. Temporary limit circles and starting marks can be made on surfaces with tape, chalk, or chalk dust. As many as four games can be played at one time on a large playing area using the set of four basket goals and four appropriately sized play balls. Game score count, duration, and winner determination are somewhat similar to that of European team handball.

FIG. 6 shows general layout for playing "Mini-Basketball", in which playing area of about 8 mts (8 yds) width by about 10 to 15 mts (10 to 15 yds) long is generally indicated by numeral 1, playing surface of smooth, hard, and level material, either indoors or outdoors, is indicated by 2, a pair of inverted assembled basket goals on surface 2 is indicated by 5, a 4 mts (4 yds) diameter limit circle 32 surrounds each goal 5, and a central game starting spot is indicated by 31. Letters A and B under circles indicate respective goals for competing teams. Area represented by 34 outside circles 32 is valid playing area where shot at goal is permitted, and areas 33 inside circles 32 are non-valid areas for offensive and defensive game play. A loose ball in area 33 can be cleared by either team using hands or feet, but players normally can not remain in area 33 for more than three seconds without drawing a minor penalty. "Mini-Basketball" is a dynamic, informal, non-contact type game played by two teams of four to eight players each. A ball indicated by 30 is a lively, lightweight plastic or rubber type about 12.5 to 15.0 cms (5 to 6 inches) in diameter, and it can be passed or bounced as in basketball. Game is started by referee making a standard ball toss "jump" or a novel ball bounce type "jump" between two competing players at starting spot 31 at midpoint between goals. Ball is moved about as in basketball but ball possession is limited to 5 seconds per player and 10 seconds per team per possession, or possession is lost to opposing team. Game play is very similar to regular basketball but shot at goal must be from outside circle. Defender can put one foot only in circle. Fouls are about the same as in basketball since this is a non-contact type game. Major or dangerous fouls result in penalty shot(s) at goal 2 mts (2 yds) back from circle. A field goal is two points; a penalty shot goal is one point. Three point plays are possible if shooter is fouled on a shot which scores. In general, game play rules can be adjusted to suit age of players and degree of formality of game play. Existing jump circles on a standard basketball court can be used as the limit circles for the novel game. Game score count, general rules, duration, and winner determination are very similar to standard basketball. To make a more challenging type basket goal for this game, two assembled baskets can be stacked one on top of another in a wasp waist type pattern fastened by spring clips. For either type goal, an anchor can be attached inside bottom of goal for more stability if so desired. Also, different colored goals for competing teams are suggested.

Figure 7:
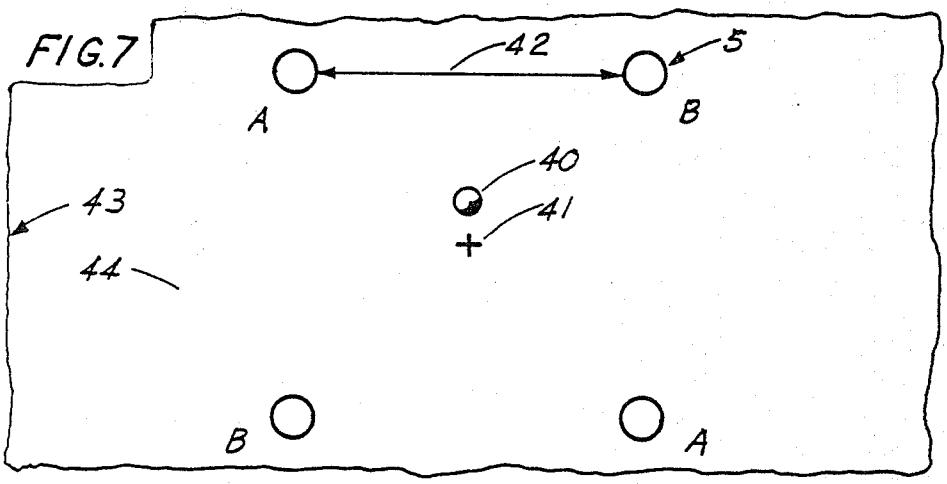
FIG. 7 is a plan view of game area showing placement of four basket goals, game starting spot, and game ball for a mini-version of football (soccer).

FIG. 7 shows general layout for playing "Mini-Square Football (Soccer)", in which playing surface of at least 20 mts (20 yds) square is generally indicated by numeral 43, playing surface of fairly smooth, hard, and level material, either indoors or outdoors, is indicated by 44, four assembled basket goals in inverted positions in a square pattern on surface 44 are indicated by 5, and a centrally located game start spot, marked or assumed, is indicated by 41. Goals 5 are placed at corners of a 10 mts (10 yds) square in center of playing area 43 with square side distance indicated by 42, and with goals of teams A and B at opposite corners of square pattern. Use different colored baskets for the team goals. No formal boundary lines or field markings are needed. "Mini-Square Football (Soccer)" is a dynamic, informal type game played by two teams of four to eight players each. A ball indicated by 40 is a standard football (soccer ball) or a heavy plastic or rubber type ball about 17.5 to 20 cms (7 to 8 inches) in diameter. Play is started by drop of ball by referee between two competing players at mark 41. All other players are outside square pattern until ball is touched by a player after drop. Game play in general is same as regular football (soccer), except that a score point is made by ball striking either of the two team goals. No off-side rule is used. In general, minor fouls result in loss of ball possession, and major or dangerous fouls result in a penalty goal kick. Such a kick is made by placing ball and fouled player next to one of his own goals, and with fouling player at center mark 41. On signal, player with ball tries to advance and kick ball against either of opponent's goals within 5 seconds for a point score. Opponent tries to stop attempt. All other players must remain clear of area. If score is made, same team restarts play from center mark 41, with all other players outside square until ball is touched. In restart of play after regular score, opposing team takes ball possession and restarts play as described above. Marked or assumed boundary lines can be used, and if ball goes out of bounds, it is brought in as in regular football (soccer). Play can extend beyond square pattern, but ball must touch surface inside square within 15 seconds if in possession of only one team, or possession is lost. In general, game play rules and distance between goals can be adjusted to suit age of players and degree of formality of game play.

Figure 8:
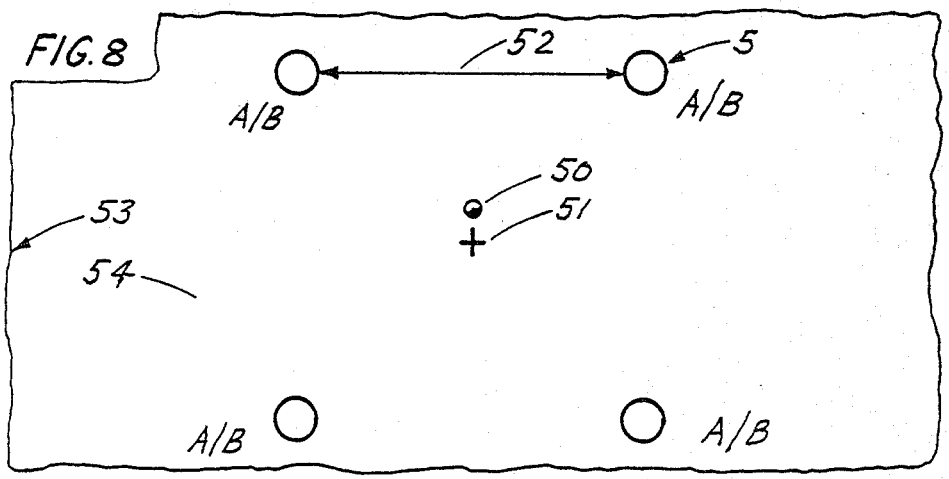
FIG. 8 is a plan view of game area showing placement of four basket goals, game starting spot, and game ball for a new and unique team game referred to as "Team Tap Ball".

FIG. 8 shows general layout for playing a new and unique game referred to as "Team Tap Ball", in which playing surface of at least 10 mts (10 yds) square is generally indicated by numeral 53, playing surface of fairly level sand, dirt, grass, concrete, asphalt, wood, or even snow or shallow water, is indicated by 54. Four assembled basket goals in an inverted position in a square pattern on surface 54 are indicated by 5, and a centrally located spot, marked or assumed, is indicated by 51. Goals 5 are placed at the corners of a 5 mts (5 yds) square pattern on surface 54, with square side distance indicated by 52. If playing in shallow water, use simple float rings with anchors attached to support basket goals. In game play, any goal can be used for score by either of two teams, as indicated by letters A/B adjacent to all goals in FIG. 8. No formal boundary lines or field markings are needed. "Team Tap Ball" is a new, unique dynamic type game requiring skill, strategy, team work, and considerable physical effort, yet is safe, inexpensive, easy to set-up and learn, and can be played on practically any type of surface. Game is normally played with two teams of three players each, using four basket goals and a lively, lightweight plastic or rubber type ball indicated by 50, about 10.0 to 12.5 cms (4 to 5 inches) in diameter. Two or four players per team can also play if number of goals is changed to be one more than the number of players per team. Theoretically in game play, there is always at least one unprotected goal open for score. Play is started by two competing players with ball drop bounce or ball toss in air by referee at center mark 51, with all other players outside of basket goal pattern until ball is touched by a player. Type of game play is unique. Ball can only be touched with flat of either hand of players. That means ball can only be tapped, slapped, passed, etc. by hand used as a paddle. Cupping of hand is not permitted. A player with ball can tap ball a maximum of three times only per possession. To avoid loss of ball possession, player must then shoot for goal or pass to team mate. The object of game is to tap ball into any basket goal for a two point score. If ball falls to playing surface during game play, ball possession goes to opponent of team that last touched ball. Restart of play is at spot where ball fell to surface. Player making restart tosses ball in air and taps it with hand but can not shoot for goal, and all other players must be at least 2 mts (2 yds) from restart player. Minor fouls result in loss of ball possession, and major, dangerous, or repeated minor fouls result in penalty tap(s) at a goal at 5 mts (5 yds) distance away. Each penalty tap goal is a one point score. Three point play scores are possible if shooter is fouled on a shot which scores, as in basketball. After a score, opponent of scoring team gets ball at center mark. If two competing players touch ball at same time as it falls to playing surface, restart play at center mark as at start of game. If two competing players touch ball firmly at same time as it goes into a goal, each team receives one point score, and play is restarted as at start of game. Only player having full control of ball can make valid score, even if ball is deflected by opposing player in scoring process. Players can not touch basket goals. If goal is disturbed at time of shot, score is granted to shooting team and a penalty shot is also awarded. Other penalties resulting from various fouls are employed in game play as logic dictates. In general, game play rules, distances between basket boals, and game duration can be adjusted to suit age of players and degree of formality of game play.

The invention may be embodied in other specific forms without departing from the spirit or essential attributes thereof and, accordingly, reference should be made to the attached claims, rather than to the foregoing description as indicating the scope of the invention.

I claim:

1. Multi-sectional assembled basket goals and their games usage wherein each of said basket goals comprises a multiplicity of thin plate-like sections of pliable sheet plastic material with a general 3-dimensional trapezoidal shape as cut from a frustum of a thin-walled cone, with the two unequal length sides of said trapezoidal shape being curved and the two equal length sides of said trapezoidal shape being straight, with said unequal length sides having stiffening rims attached thereto and said equal length sides having edge jointing means consisting of an elongated, partially cylindrical material male body with a diameter substantially greater than the thickness of each of said sections formed longitudinally along the full length of one jointing side edge of each of said sections and an elongated, partially cylindrical receptive mating female channel formed longitudinally along the full length of the opposite jointing side edge of each of said sections, said male body of one said jointing side edges of said sections being able to be inserted lengthwise into and frictional held in said receptive mating female channel of said jointing side edge of another of said sections, thus permitting the lateral jointing of a multiplicity of said sections and forming a continuous and substantially circular walled structure having the appearance of a bottomless basket, whereby said basket goals, together with appropriate game balls, playing area, and playing surface, can be used in a variety of simple indoor/outdoor team action games.

2. Multi-sectional assembled basket goals and their games usage according to claim 1 wherein each of said plate-like sections has a multiplicity of perforations.

3. Multi-sectional assembled basket goals and their games usage according to claim 1 wherein a mini-version of European team handball can be played in a 10 mts (10 yds) square playing area on a smooth, hard, and level playing surface, by two teams of four to eight players each, using a 12.5 cms (5 inches) diameter lively ball, and one said basket goal placed in an inverted position on said playing surface in center of a 4 mts (4 yds) diameter limit circle and in the center of said playing area, with both of said teams able to score in same said basket goal.

4. Multi-sectional assembled basket goals and their games usage according to claim 1 wherein a mini-basketball game can be played in an area about 8 mts (8 yds) wide and about 10 to 15 mts (10 to 15 yds) long on a smooth, hard, and level playing surface, by two teams of four to eight players each, using a 12.5 to 15.0 cms (5 to 6 inches) diameter lively ball, and two of said basket goals, one each of said basket goals being placed in an inverted position on said playing surface in center of a 4 mts (4 yds) diameter limit circle near each end of said playing area, whereby each of said teams can score in an assigned goal.

5. Multi-sectional assembled basket goals and their games usage according to claim 1 wherein a mini-square football (soccer) game can be played in an area at least 20 mts (20 yds) square on a fairly smooth, hard, and level playing surface, by two teams of four to eight players each, using a standard football (soccer ball) or 17.5 to 20.0 cms (7 to 8 inches) diameter heavy duty play ball, and four of said basket goals, with one each of said basket goals being placed in an inverted position on said playing surface at the four corners of a 10 mts (10 yds) square in the center of said playing area, with diagonally opposite positioned said basket goals being striking goals for score by respective said teams.

6. Multi-sectional assembled basket goals and their games usage according to claim 1 wherein a team tap ball game can be played in an area at least 10 mts (10 yds) square on practically any type of fairly level surface, by two teams of three players each, using a 10.0 to 12.5 cms (4 to 5 inches) diameter lively ball, and four of said basket goals placed in an inverted position on said playing surface at the corners of a 5 mts (5 yds) square in the center of said playing area, with any of said basket goals being valid for a score by either of said teams in game play featuring tap of said ball in air only, and use of flat of hand only for passing of said ball and for shooting into said basket goals for score.

* * * * *